US005117398A

United States Patent [19]

Jeter

[11] Patent Number: 5,117,398

[45] Date of Patent: May 26, 1992

[54] WELL COMMUNICATION PULSER

[76] Inventor: John D. Jeter, 1403 Teche Dr., St. Martinville, La. 70582

[21] Appl. No.: 508,047

[22] Filed: Apr. 11, 1990

[51] Int. Cl.[5] ..... G01V 1/40

[52] U.S. Cl. ..... 367/85

[58] Field of Search ..... 367/85, 83

[56] References Cited

U.S. PATENT DOCUMENTS

| | | | |
|---|---|---|---|
| 4,628,495 | 12/1986 | Peppers et al. | 367/85 |
| 4,742,498 | 5/1988 | Barron | 367/85 |
| 4,825,421 | 4/1989 | Jeter | 367/83 |
| 4,914,637 | 4/1990 | Goodsman | 367/83 |

*Primary Examiner*—Ian J. Lobo
*Attorney, Agent, or Firm*—John D. Jeter

[57] ABSTRACT

A downhole mud pressure change signal generator has a signal valve to variably resist the flow of mud down the drill string bore. The valve is powered by a bias driver and controlled by a holding magnet that is in turn controlled by a downhole instrument. The bias driver has a spring opposed fluid powered piston that moves in response to changes in fluid pressure drop across the signal valve. The valve in normally biased closed. The bias driver is resiliently connected to the valve such that when the piston moves the bias driver in response to fluid pressure that overcomes the spring, the valve is urged toward an open position. When the valve is open and signal pressure across the valve is low the spring exerts more force than the piston and the driver urges the valve toward a closed position.

The valve is urged to move but not compelled and is subject to latching in desired positions without losing the power needed to move later. The bias driver is used to power a latch that holds the valve open or closed. The energy is invested in springs that move the latch when holding magnets permit the latch to respond to the bias. The holding magnets never depend upon a flux gap because they hold positions the springs have provided.

20 Claims, 4 Drawing Sheets

WELL COMMUNICATION PULSER

This invention pertains to mud pulse generators for use in drill strings for well drilling and related work. Signals produced in drilling fluid streams by causing brief time distributed flow resistance changes at a downhole location for detection at the surface may qualify as change-of-state signals but are usually called pulses. The apparatus of this invention may utilize either system.

BACKGROUND OF THE INVENTION

Measurement While Drilling is a well established art and utilizes the drilling fluid stream pumped down the bore of a drill string as a communication link between instruments downhole and detection equipment on the surface. The earlier uses relied upon brief pulses in drilling fluid pressure caused by signal valves located downhole. A brief change in flow resistance was followed immediately by restoring the original condition. The pulse reached the surface for detection. The pulses were time distributed in a manner defined by the encoding preference of the designer for compatibility with surface gear.

Change-of-state signal generators cause a change in the flow resistance of the signal valve and that change alone is information. The next signal usually restores the original flow resistance. It may not be necessary to predetermine if the change is an increase or a decrease in flow resistance.

Both positive and negative pulse generators are in use. The positive signal valve usually resists the main stream of mud flow. The negative pulser usually bypasses some fluid to the well annulus through the drill string wall to reduce pressure at the standpipe. Both types may be used in the change-of-state manner described above.

Downhole apparatus may be installed in the drill string and is only recoverable when the string is tripped. Shuttle pulsers can be lowered and recovered through the bore of the drill string. The shuttle systems may carry the signal valve or may co-operate with an orifice situated near a landing baffle in the drill string that supports the shuttle downhole. Apparatus of this invention may be used either installed or incorporated into a shuttle system and may use either form of signal valve.

When mud pulse communication was new to the drilling industry drill bit life was in the order of fifty hours. Even fifty hours challenged the reliability of downhole instruments and pulsers of the time. When bit life was improved to approach two hundred hours the shuttle system was needed to permit change-out of downhole communication gear without tripping the drill string. The shuttle embodiment had to traverse the length of the drill string bore and radial dimension, already confining, was further reduced. Downhole electric energy sources, other than mud driven generators, were a limiting problem. The large surge current required for the pull-in phase of the conventional solenoid reduced life expectable from available batteries. The shuttle systems encountered life limits of a new form. When the power consumption problem is solved and greater endurance evolves in the rest of the system the need for the shuttle system may diminish because the shortcomings of the installed version will simultaneously be solved.

Solenoids have no peers for simplicity and reliability but the draw-in current requirement, to produce a specified force, is proportional to the draw-in distance. Shortening the draw-in distance approaches the amplitude of excursions of a vibrating drill string and solenoid forces have to be increased, diminishing the gains from reduced solenoid stroke. Acceleration forces one hundred times the force of gravity can be expected. There is a dire need to compensate for the acceleration and to eliminate the solenoid. Apparatus of my U.S. Pat. No. 5,020,609 issued Jun. 4, 1991 can eliminate the influence of acceleration on moving elements subject to the conventional draw-in forces. This invention addresses the need for mud powered machinery to supply the draw-in forces, allowing holding magnets with no flux gap to hold essential pulse timing elements in place until the associated downhole instrument delivers a signal to permit valve operating actions.

It is therefore an object of this invention to provide apparatus to bias the elements formerly moved by solenoids in the preferred direction by forces provided by mud powered moving elements within the pulser system.

It is a further object of this invention to provide apparatus, demanding electric power for actuation, that serves only a holding function subject to the control of the associated downhole instrument.

It is yet another object of this invention to provide apparatus for mud pulse telemetry that will produce the first signal pressure increase in the absence of any downhole instrument control and will use the resulting hydraulic power to open the signal valve and retain it in a failed-safe open state until a downhole instrument exercises signal controls.

It is still another object of this invention to provide apparatus for downhole signal pressure change generation that is capable of sending signals to the downhole instrument concerning the onset of drilling fluid flow and the relative positions of the principal functional elements of the signal generator.

These and other objects, advantages, and features of this invention will be apparent to those skilled in the art from a consideration of this specification, including the attached claims and appended drawings.

SUMMARY OF THE INVENTION

A drilling fluid pressure change signal generator for use in well bore communication has a signal valve to variably resist the flow of drilling fluid. The valve is resiliently urged by an actuator to always move to the position opposite the one occupied by an actuator powered by the drilling fluid pressure drop across the signal valve. The valve is latched automatically in each position, open or closed, upon arrival at that position by a latch also resiliently urged by the actuator to move to a position opposite that occupied. The two available positions are latch valve closed or latch valve open. Although the latch is urged to actuate it is only permitted to actuate when signals from an associated downhole instrument sends a signal to a holding device to release the latch. The valve then is under control of the downhole instrument even though actuating power for both valve and latch is provided by a bias driver.

The bias driver is spring biased in one direction when there is little pressure drop across the valve, and is driven by a fluid powered piston and cylinder arrangement to overcome the spring and move in the opposite direction when there is a signal pressure drop across the valve. The bias driver carries springs !o resiliently urge the valve to move in sympathy A second set of springs similarly urges a latch control element to move in sympathy. An electro-magnet holding the latch, on signal from the instrument, releases the latch element and, when it moves, it releases the valve to also move in the direction urged. That valve movement changes !he resistive state of the valve which in turn causes the piston of the bias driver to move to the opposite position and the cycle is endlessly repeated. The resulting drilling fluid pressure change signals are time distributed for encoding by the instrument and its ability to control the larch.

In the preferred embodiment the signal valve comprises an orifice mounted in the bore of the drill string and a cooperating poppet mounted in a shuttle body supported in the drill string by a locator near the orifice. The poppet extends from the body to reciprocate toward the orifice for a valve closed position and away from the orifice for a valve open position. Inside the body a bias driver is situated peripherally around the poppet and reciprocates coaxially. The driver is powered by a piston sealingly situated in the body in a bore ported to the drilling fluid stream upstream of the orifice. Reference pressure, inside the body is established by a bore through the poppet. When the poppet is in the closed position the poppet bore accesses pressure from the drilling fluid stream downstream of the orifice. When the poppet is in the open position the bore accesses drilling fluid pressure from the drilling fluid stream upstream of the orifice. The bias driver piston is spring loaded to move the piston toward the ports. When the poppet is in the open position the pressure difference influencing the piston is low and the driver moves toward the ports and the orifice. When the poppet is in the closed position the pressure on the piston moves it to overcome the spring and move the driver away from the orifice.

Springs carried by the driver engage the poppet and resiliently urge the poppet to move in sympathy The poppet has an extension with a latch arrangement that latches it in either the open or closed position once it arrives at either position. The bias driver also carries springs that engage a latch operating element that has two functional positions. One position releases the poppet from the open and latched position and sets the latch to latch the poppet in the closed position when it arrives at that position. In the alternate position the latch operator causes the latch to release the poppet from the closed position and sets the latch to latch the poppet in the open position when it arrives at that position. Movement of the driver is such that it urges the poppet in a direction and urges the latch operating element to unlatch the poppet and allow it to move with the driver.

The latch operating element is restrained in each extreme position when it arrives at that position by holding magnets. The latch operating element only moves to release the poppet when an associated downhole instrument actuates the magnet to release !he latch operating element. By these processes the movement of both poppet and latch operating element are powered by the bias driver but actual actuation of the latch, and hence poppet movement, is under control of the downhole instrument for time distribution of the pressure change signals produced by the controlled poppet.

Preferably, one of the latch operating element restraining magnets is a permanent magnet that holds the poppet open until the downhole instrument actuates a field coil that opposes the magnetic field of the permanent magnet to release the latch operating element. In the case of failure of the downhole instrument to exercise control the pulser is restrained in the open state.

An alternate embodiment provides for the poppet extension to carry the springs that bias the latch operating element. The results are the same in !hat the bias driver provides power to operate both poppet and latch but that power is temporarily invested in poppet carried springs. When the poppet is open, for instance, the latch operator is urged to release the poppet from the open position and set the latch to latch the poppet in the closed position when it arrives at that position.

Optional features allow the bias driver to operate a switch that signals the downhole instrument that drilling fluid flow exists. Additionally, an optional latch utilizes a poppet extension that is a piston in a sealed bore with valves operated by the latch operator to allow the piston, and hence the poppet, to move only when the holding magnets allow the latch operator to move.

BRIEF DESCRIPTION OF DRAWINGS

In the drawings wherein like features have similar captions.

DETAILED DESCRIPTION OF DRAWINGS

Figure 1:
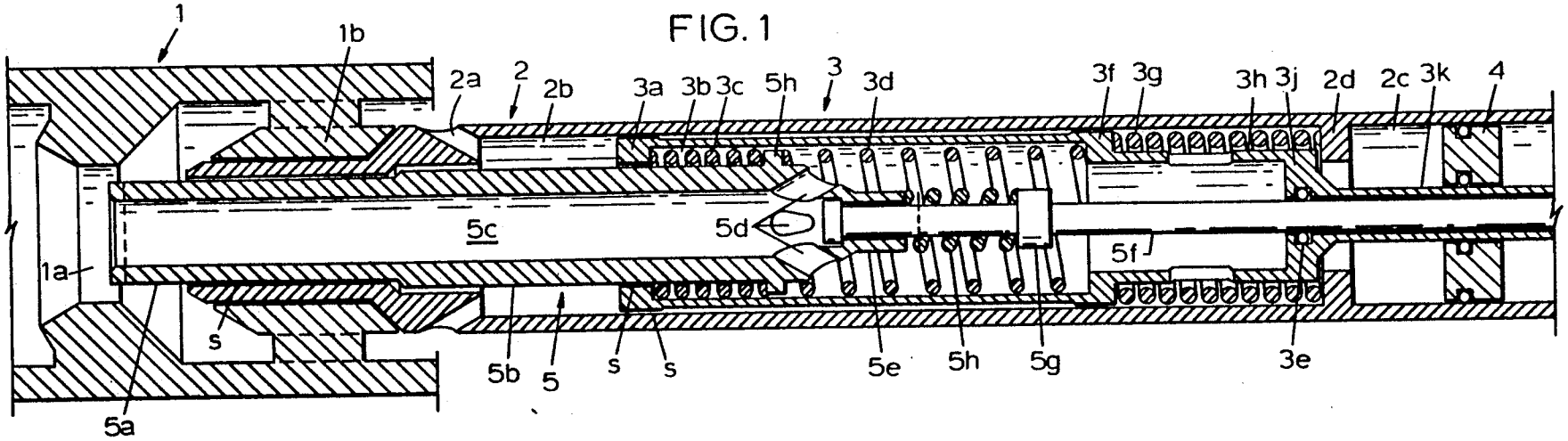
FIG. 1 is an elevation, mostly in cut-away, of the preferred embodiment of the apparatus.

In the drawings various details related to manufacturing and maintenance utility, but not bearing upon the points of novelty, are omitted in the interest of descriptive clarity. Threaded connections, some oil galleries, wiring and wiring chambers are omitted. Oil fill and vent ports and snap ring retainers are not shown. Some adjacent surfaces requiring some fluid sealing ability are captioned s.

In FIG. 1 a length of drill string 1 is shown with an integral orifice 1*a*. The orifice is usually removable as an expendable. Support 1*b* usually incorporates a muleshoe arrangement if the shuttle form of body is used. Muleshoes are in the art and none is shown. The support is usually also removable from the drill string. A shuttle housing 2 is shown and is preferred but the apparatus contained can be installed in a segment of drill string.

A signal valve variably resists the flow of drilling fluid down the drill string bore and comprises orifice 1*a* and poppet valve extension 5*a*.

Figure 2:
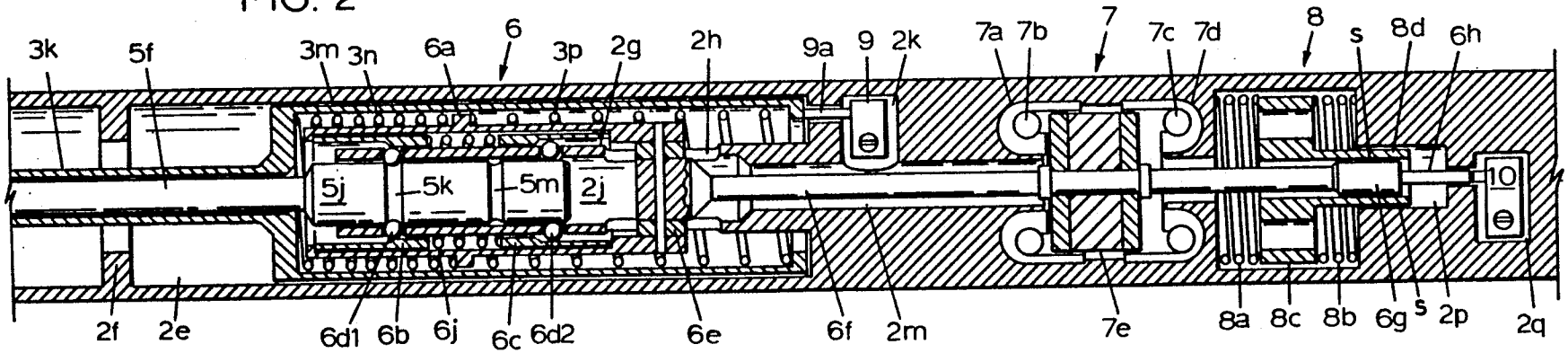
FIG. 2 is an elevation of a continuation of FIG. 1, similarly cutaway.

Housing 2 continues upward to the right, through FIG. 2 and extends to, or further extends to include, enclosures for a battery pack or other source of electric power, and enclosures for a downhole instrument and finally an overshot spear to recover the shuttle body through the drill string bore. The power pack, instrument, and spear head are in the art and are not part of the novel material of this invention.

Assembly 3 is a bias driver that peripherally surrounds and moves coaxially with the poppet. It carries opposed springs 3*c* and 3*d* that urge but do not compel the poppet assembly 5 to move in unison. The bias driver continues as tube 3*k* to include spring carrier 3*m* and all moves as a single unit. Tube 3*k* permits mud and oil separator piston 4 to provide an oil filled enclosure for more delicate parts.

Spring carrier 3*m*, part of the bias driver, carries opposed springs 3*n* and 3*p* which act against a flange to urge but not compel latch shuttle 6*a* to move in sympathy with the bias driver.

The latch shuttle cannot move axially until released by holding magnet assembly 7. The holding magnets are controlled by signals from the downhole instrument.

Assemblies 3, 5, and 6 have only two functional positions each, either fully down (left) or fully up (right). Other positions are transient only. Those assemblies are each shown in their functional positions in FIGS. 1–4 but all combinations are not shown but are described.

Figure 3:
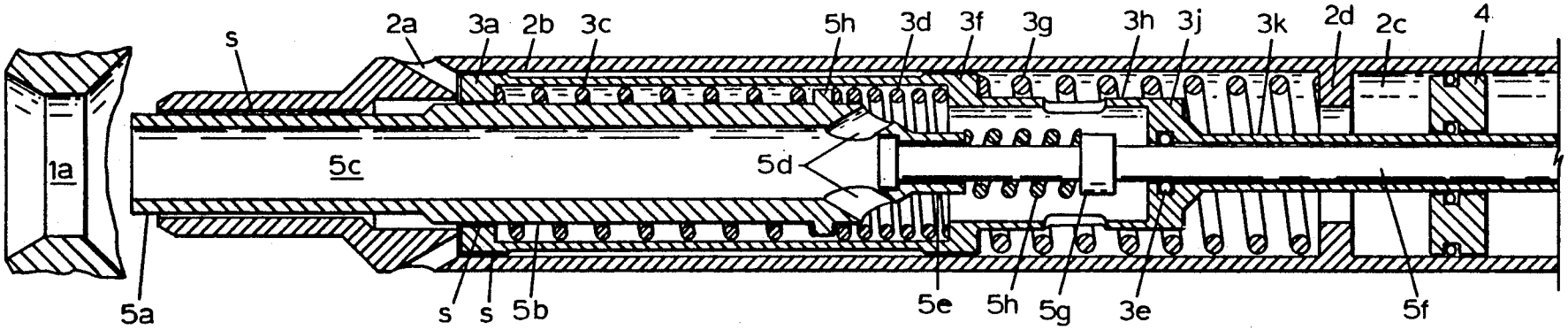
FIG. 3 is identical to FIG. 1 with the principal elements shown in the alternate functional positions.

With no drilling fluid flow and no holding magnet active, poppet assembly 5 will be down as shown in FIG. 1. The bias driver will be down, urged there by spring 3*d* as shown in FIG. 3. The lock shuttle will be down as shown in FIG. 2 and in that position latches latch extension 5*j* and, hence, latches the whole poppet assembly down.

When drilling fluid flow starts, a pressure drop occurs across orifice 1*a* and the general enclosure of housing 2 will receive pressure from downstream of the orifice through the bore 5*c* of the poppet and ports 5*d*. Piston 3*a* receives fluid pressure from the drilling fluid stream upstream of the orifice through ports 2*a*. Piston 3*a* is not tightly sealed relative to the poppet or to the wall of cylindrical opening 2*b*. Some leakage prevents the collection of silt. The source of hydraulic power is the mud stream and is massive and piston 3*a* moves the bias driver upward overcoming spring 3*c*. Opening 2*b*, above the piston, is at lower pressure approximating the pressure drop across the orifice. Opening 3*b* in the bias driver contains springs 3*c* and 3*d* which oppose each other at poppet flange 5*h* and spring 3*c* is compressed and spring 3*d* extends. The poppet is urged upward but is latched down by rod 5*f* which is latched down by latch extension 5*j* of FIG. 2.

Under high flow conditions the poppet can move upward to reduce signal pressure irrespective of the latched down condition, permitted by spring 5*h*, note dotted lines. This is a small move compared with the stroke and energy available in spring 3*c* and energy remains to fully actuate the poppet up-stroke.

Spring carrier 3*m* is moved upward with the rest of the bias driver and spring 3*n* applies a force to the flange of latch shuttle 6*a*. Opposing spring 3*p* has less remaining energy. The latch shuttle carries cams 6*b* and 6*c*. Cam 6*b* holds latch balls 6*d*1 radially inward into groove 5*k*. This latches extension 5*j* downward. Shuttle 6*a* cannot move upward if energy is being supplied by the downhole instrument to coil 7*b* which causes magnet pole 7*a* to hold magnet plate 7*e* and, hence, rod 6*f* down.

The stroke of the bias carrier is about three times the stroke of the poppet and about ten times the stroke of the latch shuttle. The poppet travel leaves adequate energy in the driver springs to rapidly complete the stroke of the driven elements when they are permitted to move.

Figure 4:
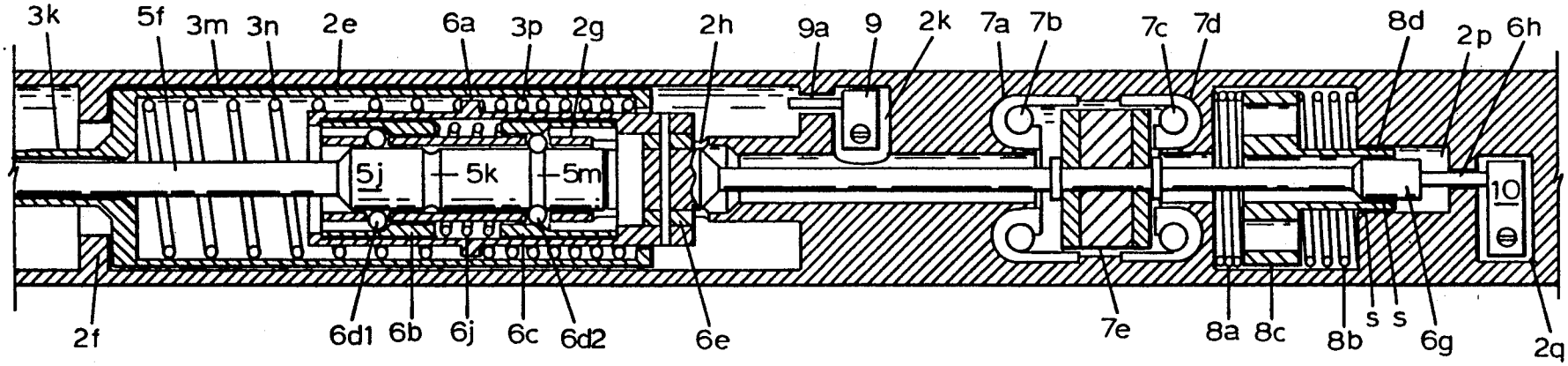
FIG. 4 is identical to FIG. 2 with the principal elements in the alternate functional positions.

When a signal from the downhole instrument causes magnet poles 7*a* to release the magnet plate 7*e* it moves rapidly to the upward position shown in FIG. 4 whether or not power is supplied to coil 7*c*. That moves shuttle 6*a* upward to the position shown. Cams 6*b* release balls 6*d*1 and the extension 5*j* is free to move. Cams 6*c* will arrive at latch balls 6*d*2 before groove 5*m* is in the position shown. Spring 6*j* allows the cam to wait for the groove and does not require a flux gap between plate 7*e* and the magnet poles 7*d*. The holding magnet need only hold the force of spring 6*j*. When groove 5*m* arrives at the position shown the balls are cammed radially inward to engage the groove and latch the poppet in the upward, or open, position. The balls will be retained by the cylindrical portion of the cam and no axial force is required to hold them inward.

The released poppet will respond to spring 3*c* which will be as shown in FIG. 1 at the time of latch release. The poppet will rise to the position shown in FIG. 3 at the time latch groove 5*m* is engaged. The pressure drop across the orifice will be reduced but the poppet bore will be open above the orifice and will access only drilling fluid pressure upstream of the orifice. There is now no differential pressure to support piston 3*a*. Shortly after the poppet reaches the open position spring 3*g* bears on housing flange 2*d*, surrounds reduced tube 3*h* of the bias driver and bears on flange 3*f* of the driver to urge it downward. Drilling fluid is discharged from ports 2*a* and the peripheral piston 3*a* allows the bias driver to move to the position shown in FIG. 3. Spring 3*d* is compressed and spring 3*c* extends. The bias driver is set to move the poppet back down once the latch is released. Spring carrier 6*a*, part of the bias driver, will then be down as shown in FIG. 4. Spring 3*p* is compressed and spring 3*n* is extended. Shuttle 6*a* is biased downward and ready to release the poppet from the up position.

When coils 7*c* are directed to do so the magnet plate is released and shuttle 6*a* moves down to release balls 6*d*2, cam balls 6*d*1 inward, and eventually capture groove 5*k* to latch the down position of the poppet.

The cycle will repeat.

Some optional features include switch 9 which detects the first response of the bias driver to the onset of drilling fluid flow. Switch actuator rod 9*a* engages the top end of the spring carrier of the bias driver when the normally closed poppet causes the first drilling fluid pulse. The first switch actuation will turn on an operable downhole instrument. Once on the instrument will ignore additional switch actions. It would be practical to turn off the instrument if no switch actuation occurs in a preselected amount of time.

Switch 10 has many uses. One use is to count pulses actually realized for comparison with those ordered by the instrument. A downhole instrument normally has substantial micro-processor ability and the sequencing and timing relationships of switches 9 and 10 offer an opportunity to diagnose anomalies developing in machine operations downhole.

Acceleration compensation system 8 is a subject of my U.S. Pat. No. 5,020,609 issued Jun. 4, 1991. Mass 8 is suspended for axial movement in an opening in the housing. It extends annular piston 8*d* sealingly slidable in bore 2*p*. Piston 6*g* has the same effective piston area as piston 8*d*. The mass has the same weight as all parts that move as dead weight with rod 6*f*. When axial vibration or shock accelerates housing 2 in either axial direction, both mass 8*c* and all elements attached to piston 6*g* tend to move in the opposite axial direction relative to the acceleration direction of the housing. The pressure in cylinder 2*p* will change an amount proportional to the amount of acceleration. If upward acceleration causes the pressure to drop, there will be no cavitation in the downhole hydrostatic environment and the two piston faces are enough. The pistons oppose or support each other to prevent movement of both in one direction but both pistons can move in opposite directions. Rod 6*f*, then, is not influenced by acceleration yet magnet plate 7*e* can move the rod as if no acceleration were present. Acceleration of one hundred Gs would require magnet plate 7*e* to oppose one hundred times the weights of all elements directly attached to rod 6*f*. That part of the required holding ability is eliminated. The pistons are only loosely sealed and springs 8*a* and 8*b* restore the mass to general center of stroke in due time.

Figure 5:
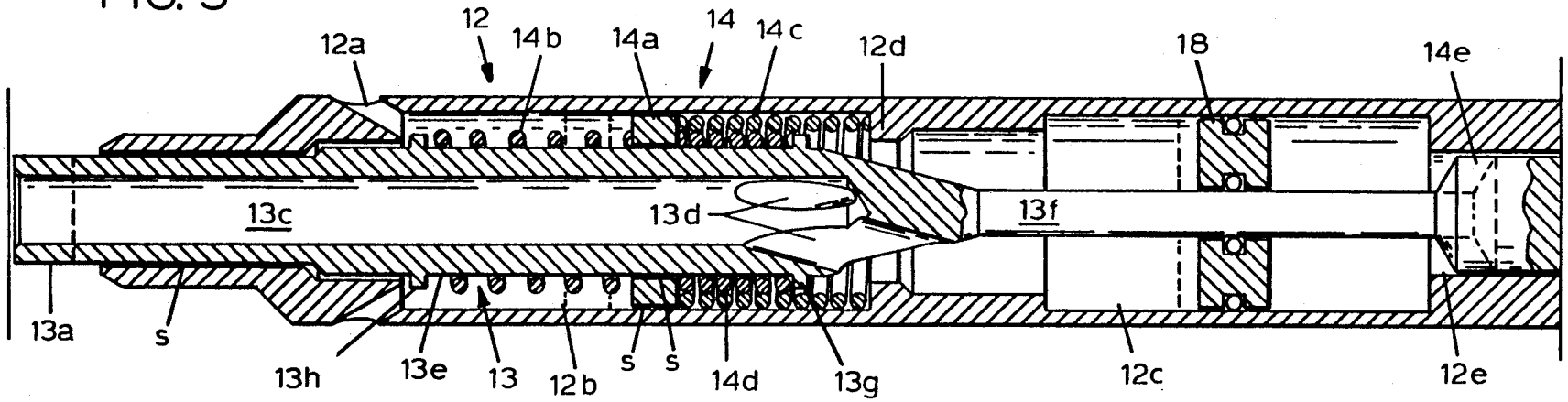
FIG. 5 is an elevation, mostly in cut-away, of an alternate embodiment of the apparatus of FIGS. 1–4.

FIG. 5 represents an alternate embodiment that can directly replace the pulser of FIGS. 1–4, utilizing the same orifice. The poppet and latch are still powered by the bias driver as before but the bias driver here utilizes the poppet itself as a spring carrier. In housing 12, openings 12*b*, and 12*c*, ports 12*a* and flange 12*d* have the same function as before.

The bias driver comprises piston 14*a*, springs 14*b*, 14*c* and 14*d*. Springs 14*b* and 14*d* urge the poppet to move in sympathy with the piston. Spring 14*c* urges both piston and poppet downward to provide means to power the first pulse after the onset of mud flow.

Piston 18, as before, provides separation between mud and oil so that the more delicate machine elements can operate in a sealed, oil filled, enclosure.

Control rod 13*f* controls the axial movement of the poppet. Latch extension 14*d* is part of the poppet assembly and is engaged in one of two functional positions by latch balls 15*d* and 15*c*. The latch balls are captured in radial holes in nipple 12*f* which is part of the housing. Latch shuttle 15*a* carries cams 15*b* and 15*c* which cam the balls into the latch grooves, one of which is shown as 14*f*.

Extension 14*e* carries springs 14*h* and 14*j* in opening 14*g* which are in opposition at flange 15*j* and urge rod 15*h*, crosshead 15*g* and, hence, latch shuttle 15*a* to move in sympathy with the poppet.

Holding magnet assembly 16 is identical to assembly 7 of FIG. 2 and is under control of the downhole instrument. Acceleration compensation assembly 17 is also identical to assembly 8 of FIG. 2.

It is noteworthy that spring 14*c* can be used to apply force directly to the poppet by placing it between flanges 12*d* and 13*g*. In the configuration shown springs 14*b* and 14*c* collectively apply force directly to the poppet.

When the shuttle moves to release the poppet from one position it automatically sets cams to latch it in the opposite position. When the poppet moves it biases the shuttle to unlock it from the position moved into.

Figure 6:
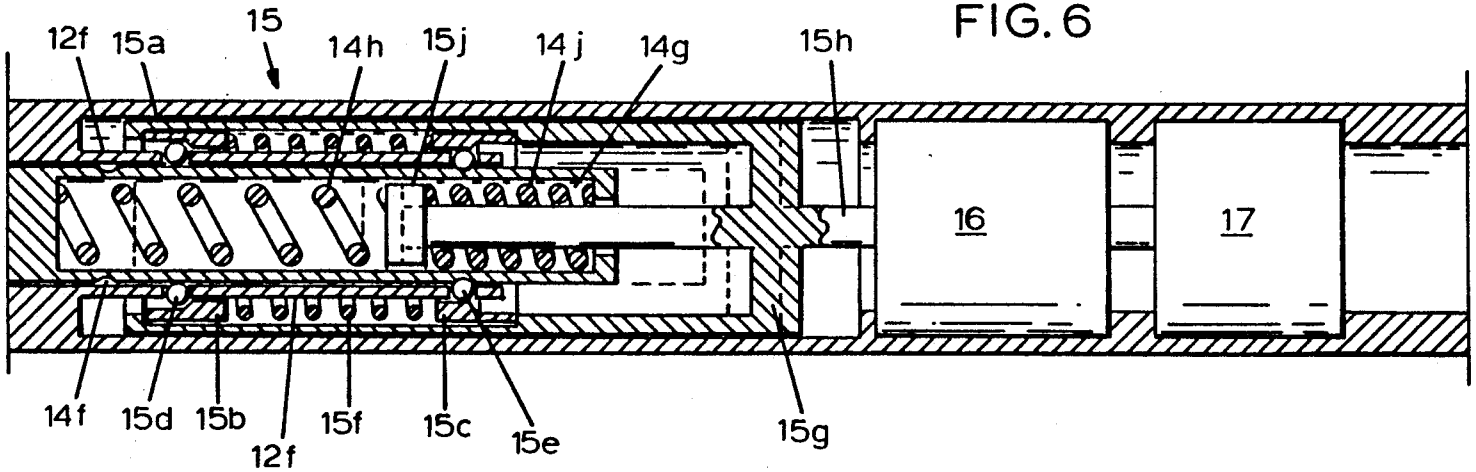
FIG. 6 is an elevation, mostly in cut-away, of a continuation of FIG. 5.
Figure 7:
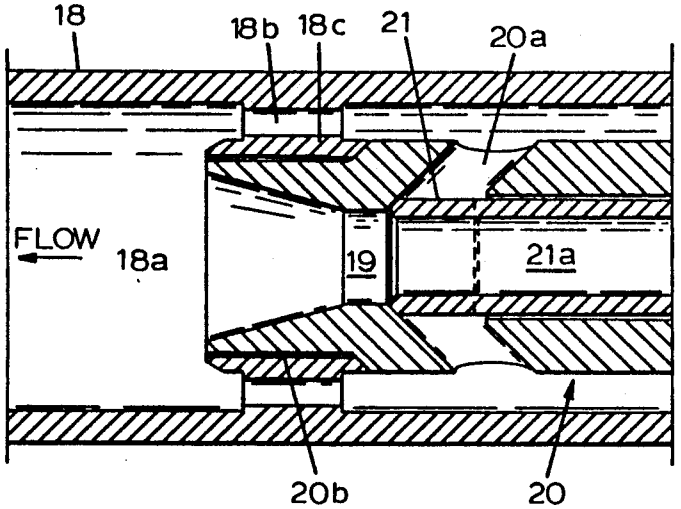
FIG. 7 is an elevation, mostly in cut-away, of an adaptation of the apparatus of FIGS. 1, 3, and 5 to carry an orifice in the same body as that carrying the poppet.

In FIG. 7 the orifice that cooperates with the poppet to provide a signal valve is carried in the housing with the poppet. In housing 20 orifice 19 receives drilling fluid flow by way of ports 20*a*. The shuttle body is positioned and supported in the drill string by support 18*c* which receives pilot 20*b*. Support 18*c* optionally, has by-pass channels 18*b* so that the orifice carries only part of the total drilling fluid flow. Flow area 18*a* can either be for the downwardly continuing stream of drilling fluid or it can be a negative pulser by-pass channel to conduct drilling fluid through the drill string wall to the well annulus. Poppet 21 reciprocates as previously described herein. Poppet bore 21*a* also as previously described accesses drilling fluid pressure from downstream of orifice 19 when the poppet is in the closed position. When it is in the open position the bore accesses pressure from upstream of the orifice. The upper end of the pulser can be identical to that of FIGS. 1 and 2 or 5 and 6.

Figure 8:
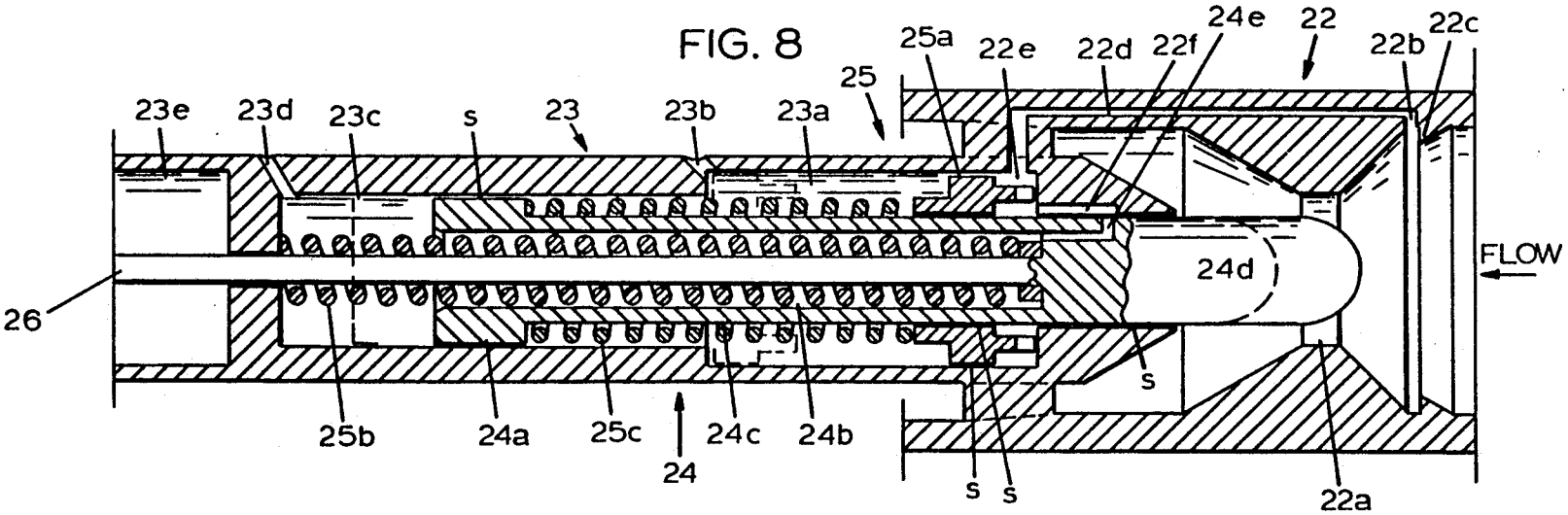
FIG. 8 is an elevation, mostly in cut-away, of the apparatus operating on the same principles as that of FIGS. 1, 3, and 5 but situated and adapted to operate downstream of the orifice.

FIG. 8 shows the poppet downstream of the orifice and demonstrates the use of only two springs to bias poppet and bias driver. Flow direction is shown by the arrow. There is no separate shuttle body and the housing is all part of the drill string 22. Above orifice 22 pebble shield 22*c* protects annular port 22*b* which directs drilling fluid into channel 22*d* which extends through a support leg into chamber 22*e* which is cylindrical opening 23*a* above bias driver piston 25*a*. When the poppet extension 24*d* is in position to cause signal pressure the poppet is in about an equilibrium state axially because piston 24*a* in bore 23*c* is thrust upward by greater pressure in bore 23*c* than that in chamber 23*a*. Pressure in chamber 23*c* arrives from chamber 22*e* through ducts 22*f*, 24*e* and bore 24*b*. There is a small leakage through port 23*d* to reduce silting. Fluid pressure entering port 23*b* is from downstream of the orifice and lower in pressure than the fluid supplied to chamber 22*e* and piston 25*a* is urged downward by signal pressure. Spring 25*b* always urges the poppet toward the orifice and the resulting signal pressure always urges the poppet away from the orifice by way of piston 25*a* and spring 25*c*. By way of poppet control rod 26 the poppet movement is placed under control of the downhole instrument. Refer to FIG. 5 and assume rod 26 is joined to rod 13*f* as an upward continuation into FIG. 6 and the description of control is complete.

Figure 9:
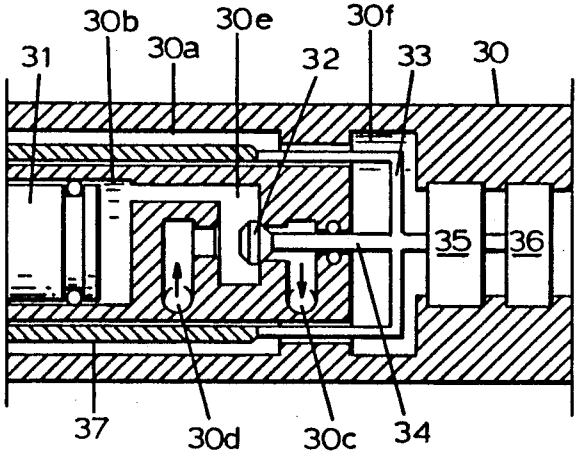
FIG. 9 is an elevation, mostly in cut-away, of an alternate latching system for the devices of FIGS. 2 and 4 utilizing the same source of power.

FIG. 9 shows a hydraulic means to accomplish the ends sought for the previously described ball latches. In housing 30 cylinder 30*b* sealingly accepts piston 31 for axial movement. Piston 31 is the upper end of the poppet assembly equivalent to latch extension 5*j* of FIG. 2. If the piston is to move fluid must flow through channel 30*e*. Ports 30*d* and 30*c* lead first through check valves then to the general oil filled enclosure. Fluid can only move in the directions shown by the arrows. Shuttle 37 is equivalent to shuttle 15*a* of FIG. 6 and is similarly biased to move axially. Shuttle 37 is in the up position and closes port 30*c* with valve head 32. Fluid moving in port 30*d* can only flow into cylinder 30*b* and the piston can only move down(left). Holding magnet 35 and acceleration compensator 36 have been described herein and serve the same control function here. Shuttle 37 is connected by crosshead 33 in opening 30*f* to control rod 34.

The ability to drive the latch control from the poppet extension has been demonstrated in FIG. 6. To apply the same technique to the hydraulic latch shuttle 37, opening 30*a*, crosshead 33 and opening 30*f* can be eliminated. Rod 34 would extend left from valve head 32 through a sealed opening in the top of cylinder 30*b* and into an opening in the top of the piston which should be identical to opening 14g of FIG. 6. Poppet latch biasing and control would be carried out just as shown for FIG. 6.

The use of the shuttle system presents a need for some definitions. Signal pulser housings have in the past been part of the drill string with an oil filled body mounted in the bore. The shuttle system raises a question as to where the body ends and housing begins. In this application it is assumed that a shuttle body becomes part of the housing when it is in position downhole on the landing locator. The housing is a segment of drill string containing the landing locator and the body, once in place on that locator, becomes part of the housing.

From the foregoing, it will be seen that this invention is one well adapted to attain all of the ends and objects hereinabove set forth, together with other advantages which are obvious and which are inherent to the method and apparatus.

It will be understood that certain features and subcombinations are of utility and may be employed without reference to other features and subcombinations. This is contemplated by and is within the scope of the claims.

As many possible embodiments may be made of the apparatus and method of this invention without departing from the scope thereof, it is to be understood that all matter herein set forth or shown in the accompanying drawings is to be interpreted as illustrative and not in a limiting sense.

The invention having been described, I claim:

1. Apparatus for creating fluid pressure change signals for well bore telemetry in a stream of drilling fluid being circulated through the bore of the drill string, the apparatus comprising: a restriction in the bore, a cylinder located in the drill string near said restriction, a valve member extending from a guide means in said drill string toward said restriction and arranged to move between a first position near said restriction to create a preselected first signal pressure drop across said restriction and a second position farther from said restriction to produce a second pressure drop across said restriction lower than said first signal pressure drop, a piston situated in said cylinder, first spring means, situated to resiliently connect said piston and said valve member, arranged to urge said valve member to move in sympathy with said piston, second spring means, arranged to urge said valve member toward said first position, first fluid channel means to conduct fluid pressure from the drilling fluid stream upstream of said restriction into said cylinder on one side of said piston, second fluid channel means to conduct fluid pressure from the drilling fluid stream downstream of said restriction into said cylinder on the other side of said piston, the relationships between said piston and both said channel means such that said valve member will be urged to said first position when said second pressure drop exists across said restriction and will be urged to said second position when said first signal pressure drop exists across said restriction, latch means in said drill string arranged to releasably latch said valve member in at least one of said first and second positions and to release said member in response to signals from a downhole instrument for time distribution encoding of signal pressure changes in said drilling fluid stream.

2. The apparatus of claim 1 wherein said restriction is an orifice supported in the drill string bore and said valve member is a cooperating poppet.

3. The apparatus of claim 2 wherein said poppet is carried in a shuttle body movable through the drill string bore from the surface to a locator support near said orifice.

4. The apparatus of claim 3 wherein said orifice is carried in said shuttle body and a flow resistance means in said bore is arranged to urge part of said drilling fluid stream to flow therethrough by way of fluid channel means that enters said body, passes through said orifice, and opens to said drill string bore.

5. The apparatus of claim 1 wherein said latch means comprises a control member movable between a first latch position and a second latch position and in each position causes said latch to unlatch said valve member from the position occupied and prepares the latch to automatically latch said member in the other position, said control member resiliently connected to said valve member such that each time said valve member changes said positions said control member is urged to change said latch positions, and means responsive to a downhole instrument to releasably secure said control member from movement in response to a first signal and to release said control member in response to a second signal from said downhole instrument.

6. The apparatus of claim 5 wherein said means to releasably secure said latch control member comprises at least one electromagnet responsive to said downhole instrument.

7. The apparatus of claim 5 wherein said means to releasably secure said latch control member comprises at least one permanent magnet with associated electromagnet coil oriented to oppose the permanent magnet field to release said latch control member, the absence of coil energy to oppose said permanent magnet field representing one signal from said downhole instrument.

8. The apparatus of claim 4 wherein said fluid channel means enters said body, passes through said orifice, and proceeds through the drill string wall to provide a bypass fluid route for creating negative pressure change signals.

9. The apparatus of claim 1 wherein said latch means comprises a control member movable between a first latch position and a second latch position and in each position causes said latch to unlatch said valve member from the position occupied and prepares the latch to automatically latch said member in the other position, said control member resiliently connected to said piston such that each time said piston changes said positions said control member is urges to change said latch positions, and means responsive to a downhole instrument to releasably secure said control member from movement in response to a first signal and to release said control member in response to a second signal from said downhole instrument.

10. The apparatus of claim 2 wherein said second fluid channel means includes the bore of a tubular poppet, opening at the orifice end, the term downstream including drilling fluid flow regions having approximately maximum velocity caused by passage into said orifice.

11. Apparatus for the generation of drilling fluid pressure change signals, for well bore telemetry, in a stream of drilling fluid being circulated through the bore of a drill string, the apparatus comprising:

(a) a housing comprising a length of drill string with fluid tight means at one end for attachment to an upwardly continuing portion of the drill string and means at the other end for fluid tight attachment to a downwardly continuing portion of the drill string;

(b) an orifice, with an upstream side and a downstream side, situated in the bore of said drill string and arranged to accept at least part of said drilling fluid stream therethrough;

(c) a poppet mounted for reciprocating movement in said housing between a first position near said orifice to produce a signal pressure drop therethrough and a second position farther from said orifice to produce a pressure drop lower than said signal pressure drop;

(d) actuator means situated in said housing comprising a fluid power cylinder with a piston resiliently connected by a first bias means to said poppet such that said piston and said poppet are urged to move in sympathy;

(e) first fluid channel means in said housing to conduct fluid from the drilling fluid stream upstream of said orifice to said cylinder on one side of said piston and second fluid channel means to conduct fluid from said drilling fluid stream downstream of said orifice to the other side of said piston, said two channel means arranged such that increasing pressure across said orifice increasingly urges said poppet away from said orifice;

(f) position latch means in said housing arranged to releasably secure said poppet in at least one of said two positions in response to movement of a latch control member between a first and a second latch control position;

(g) second bias means arranged to urge said actuator means and said latch control member to move in sympathy;

(h) holding means situated to releasably engage said latch control member in at least one of said two latch control positions in response to a first signal from a downhole instrument and to release said latch control member in response to a second signal from said downhole instrument.

12. The apparatus of claim 11 wherein said second fluid channel means comprises the bore of a tubular poppet, opening at the orifice end, said downstream of said orifice to include flow regions where drilling fluid velocity has approached maximum due to orifice influence.

13. The apparatus of claim 11 wherein said bias means comprises at least one spring carried in said poppet and operably connected between said poppet and said latch control member.

14. The apparatus of claim 11 wherein said holding means comprises at least one permanent magnet arranged to magnetically hold said latch control member in at least one of said two latch positions.

15. The apparatus of claim 14 wherein an electromagnetic coil is situated to produce an electromagnetic field opposing the field of said permanent magnet to release said latch control member.

16. The apparatus of claim 11 wherein said piston is an annular piston situated to move coaxially with said poppet.

17. A latching apparatus for use in a downhole drilling fluid pressure change signal generator for use in well bore telemetry to secure a signal valve in selected positions when moved to said positions by a valve operator means, the apparatus comprising:

(a) valve operating means having a movable member for moving a movable valve means between a first and a second position for changing the flow resistance in a flow path thereby modulating the resistance to flow of said drilling fluid;

(b) latch means for preventing the movement of said movable member, wherein said latch means comprises;

(c) first engagement means operably connected to said movable valve means;

(d) second engagement means;

(e) latch effecting means positioned between said engagement means;

(f) biasing means operably connecting said movable member and said second engagement means to urge sympathetic movement such that when said movable member moves to one of said positions said second engagement means, if allowed to move as urged, actuates said latch means to release said member from that position and biases said latch means to latch said member in the other position when said member arrives at the other position; and (g) holding means, operably connected to said second engagement means, responsive to a downhole instrument, to prevent movement of said second engagement means until an enabling signal is received from said downhole instrument.

18. The apparatus of claim 17 wherein said holding means is a permanent magnet.

19. The apparatus of claim 18 wherein said permanent magnet is caused to release said second engagement means by the action of an electromagnet coil arranged and powered to oppose the permanent magnet field.

20. The apparatus of claim 17 wherein said first engagement means is a groove, said latch effecting means is a plurality of balls radially movable in holes in the structure of a general enclosure, said second engagement means is a cam arrangement carried by a latch control member to engage said balls.

* * * * *